US007914389B2

(12) United States Patent
Burns

(10) Patent No.: US 7,914,389 B2
(45) Date of Patent: Mar. 29, 2011

(54) GOLF PUTTER TRAINING DEVICE

(76) Inventor: John Burns, Norridge, IL (US)

( * ) Notice: Subject to any disclaimer, the term of this patent is extended or adjusted under 35 U.S.C. 154(b) by 0 days.

(21) Appl. No.: 12/499,904

(22) Filed: Jul. 9, 2009

(65) Prior Publication Data

US 2010/0016093 A1 Jan. 21, 2010

Related U.S. Application Data

(60) Provisional application No. 61/081,422, filed on Jul. 17, 2008.

(51) Int. Cl.
*A63B 69/36* (2006.01)

(52) U.S. Cl. ..... 473/238; 473/226; 473/231

(58) Field of Classification Search ..... 473/219, 473/226, 228, 229, 231, 238, 242, 253, 254, 473/266, 268
See application file for complete search history.

(56) References Cited

U.S. PATENT DOCUMENTS 3,298,693 A * 1/1967 Eisenberg ..... 473/238
3,951,415 A * 4/1976 Stuart ..... 473/238
4,174,838 A 11/1979 Paschetto
4,647,045 A 3/1987 Bilyeu
4,720,109 A * 1/1988 Kryter ..... 473/251
4,789,158 A 12/1988 Chiesa
4,921,660 A * 5/1990 Kryter ..... 473/252
4,949,971 A 8/1990 Thornton
5,022,656 A 6/1991 Tiller
5,351,961 A 10/1994 Eulau
5,716,286 A 2/1998 Swan
5,762,564 A 6/1998 Schang
6,722,999 B1 4/2004 Yi
6,872,149 B1 3/2005 Devon

* cited by examiner

*Primary Examiner* — Nini Legesse
(74) *Attorney, Agent, or Firm* — Evan Law Group LLC

(57) ABSTRACT

A golf putter training device is described. The training device includes a bracket having a first end configured to be attached to the putter shaft and a second end connected to a support shaft, a first visual guide connected to the support shaft and extending in a direction away from the bracket first end and at an angle to the plane formed by the putter shaft and the putter head and on a first side of the plane, and a second visual guide connected to the support shaft and extending in a direction away from the bracket first end and at an angle to the plane formed by the putter shaft and the putter head and on the second side of the plane. In another embodiment, the training device includes a third and fourth visual guide. In yet another embodiment, the training device includes visual indicators.

7 Claims, 4 Drawing Sheets

GOLF PUTTER TRAINING DEVICE

CROSS-REFERENCE TO RELATED APPLICATIONS

This application claims priority from U.S. Provisional Patent Application No. 61/081,422, filed Jul. 17, 2008, the disclosure of which is incorporated herein by reference.

BACKGROUND OF THE INVENTION

The present disclosure generally relates to golf and more particularly to a golf putter training device.

As great golfers, and even the not so great golfers, know, the game of golf involves hitting a golf ball with various golf clubs from different distances from a desired target, i.e., the hole or cup. Part of the game of golf, for example, involves driving the ball down the range. Ideally, a golfer will get the ball on to what is commonly referred to as the green, an area of short grass within which the cup lies, the ultimate goal into which a golfer wishes to place the ball. On the green, golfers use a golf putter to putt the golf ball into the hole. While putting a golf ball may appear simple to an outside observer, especially when done by pros on television, it requires great skill, and big championships or rivalries amongst friends may be won or lost based on one's ability to putt a golf ball. As such, professional golfers and amateur golfers alike have great need to fine tune and develop their golf putting skills.

Although putting may appear simple, a great deal of skill is required to be a great golf putter. For example, different landscapes may require a ball to be putted differently. Reading the landscape is a skill that may be acquired over time with great practice to learn how different slopes, different grass types, and other factors affect a ball's ability and likelihood to roll in certain directions on a given green. Although reading the landscape is one critical skill involved in golfing, the ability for a golfer to swing a golf putter is also critical. If a golfer can read the landscape perfectly, but cannot accurately swing the golf putter in order to cause a golf ball to go in a given direction with a given speed, the golfer will most likely not be a great player.

As with any acquired skill, practice makes perfect. In the case of golf putting, one of the benefits gained by practicing is learning what it feels like to swing a golf putter as desired. In other words, a golfer is able to develop a "muscle memory" of what it feels like to swing a golf putter to cause a golf ball to go a desired direction and a desired speed. This muscle memory may develop over time by repetitive practice swings. A golfer may simply practice over and over, time and time again, in order to develop a muscle memory. However, repetitive practice swings may not be enough. A golf putter training device may help a golfer both correctly and more quickly develop a good golf putter swing.

BRIEF SUMMARY OF THE INVENTION

A golf putter training device comprises a bracket having a first end configured to be attached to the putter shaft and a second end connected to a support shaft, a first visual guide connected to the support shaft and extending in a direction away from the bracket first end and at an angle to the plane formed by the putter shaft and the putter head and on a first side of the plane, and a second visual guide connected to the support shaft and extending in a direction away from the bracket first end and at an angle to the plane formed by the putter shaft and the putter head and on the second side of the plane. In another embodiment, the training device includes a third and fourth visual guide. In yet another embodiment, the training device includes visual indicators.

BRIEF DESCRIPTION OF THE SEVERAL VIEWS OF THE DRAWINGS

Certain embodiments are shown in the drawings. However, it is understood that the present disclosure is not limited to the arrangements and instrumentality shown in the attached drawings, wherein.

DETAILED DESCRIPTION OF THE INVENTION

Figure 2:
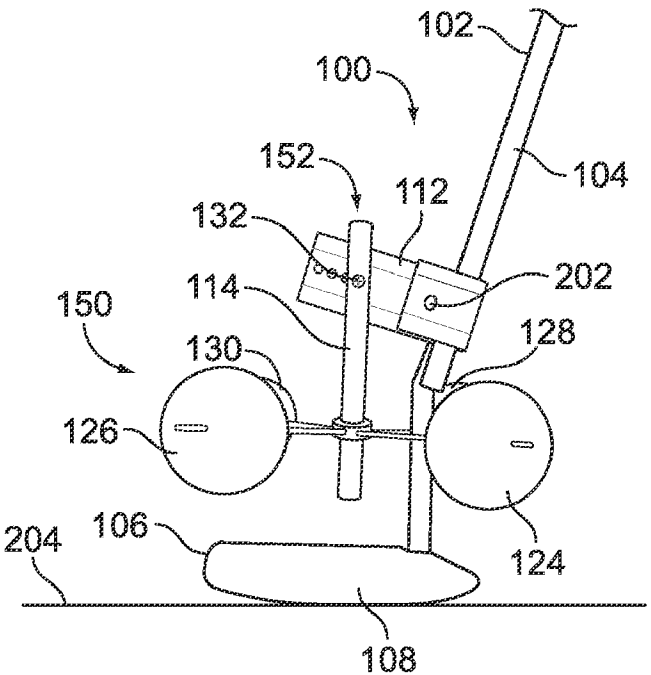
FIG. 2 is a side view of the golf putter training device shown in FIG. 1.

For the purposes of promoting and understanding the principles disclosed herein, references are now made to the preferred embodiments illustrated in the drawings and specific language is used to describe the same. It is nevertheless understood that no limitation of the scope of the disclosure is thereby intended. Such alterations and further modifications in the illustrated device and such further applications of the principles disclosed as illustrated herein are contemplated as would normally occur to one skilled in the art to which this disclosure relates.

Figure 1:
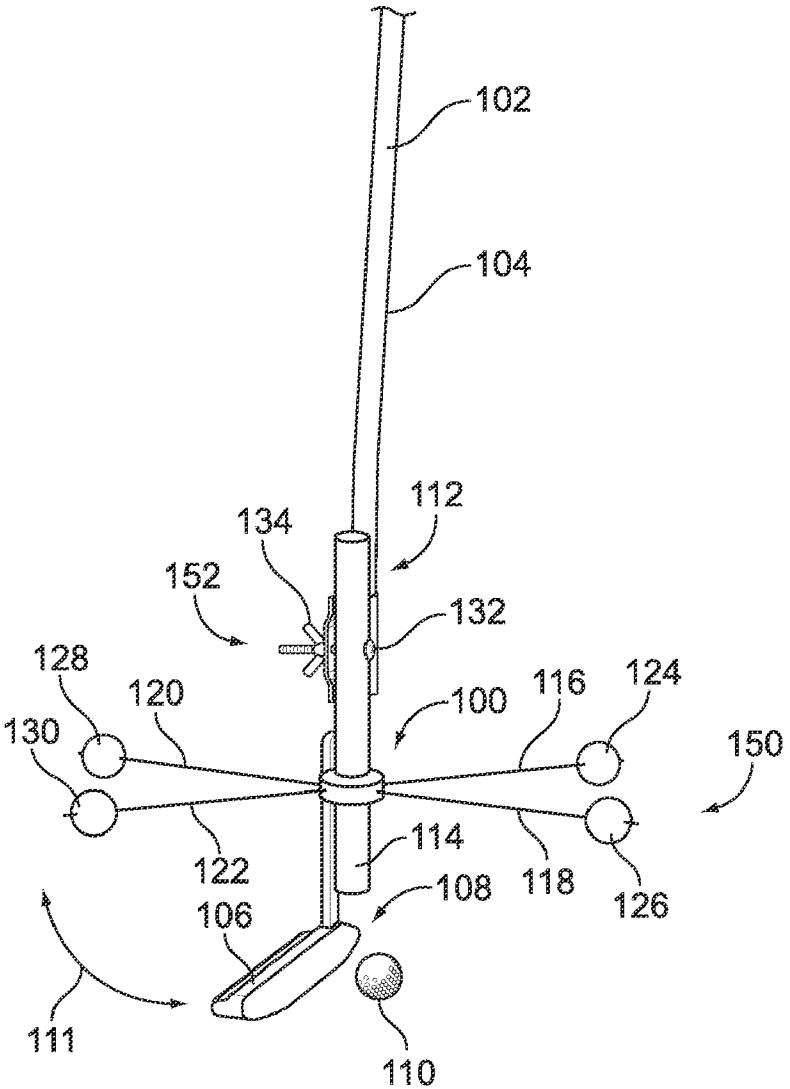
FIG. 1 is a front perspective view of an example of a golf putter training device attached to a golf putter.

FIG. 1 shows a front view of a golf putter training device 100 attached to a golf putter 102. Golf putter 102 may be any golf putter and includes, among other things, a shaft 104 (which is only partially shown and otherwise conventional in construction) and a putting head 106, which contains a putting surface 108. As shown in FIG. 1, the putting surface 108 is set in close proximity to a golf ball 110. As known in the art, a golfer (not shown) may swing the putting head 106 along a putting swing path, such as that designated by line 111, away from the ball 110 (to the left in this figure) and then forward towards the ball 110 to make contact with ball 110, thereby causing the ball to move forward (and ideally into a cup on a green).

Generally speaking, golf putter training device 100 comprises a visual guide assembly 150 and a support 152 to attach visual guide assembly 150 to shaft 104. Support 152 in the illustrated embodiment comprises a mounting bracket 112 (not visible in this figure, but see other figures herein) and a support shaft 114. Support 152 may be any means for attaching visual guide assembly 150 to shaft 104, including other types of brackets, clamps, couplings, rods, yokes, or other connectors. Visual guide assembly 150 comprises at least two visual guides 116, 118. Although not required, visual guide assembly 150 may also include two additional visual guides 120, 122. Furthermore, visual guide assembly 150 may also include visual indicators 124, 126, 128, and 130. Visual guide assembly 150 may also include a first outer visual guide 316 and a second outer visual guide 318, as described below.

Figure 5:
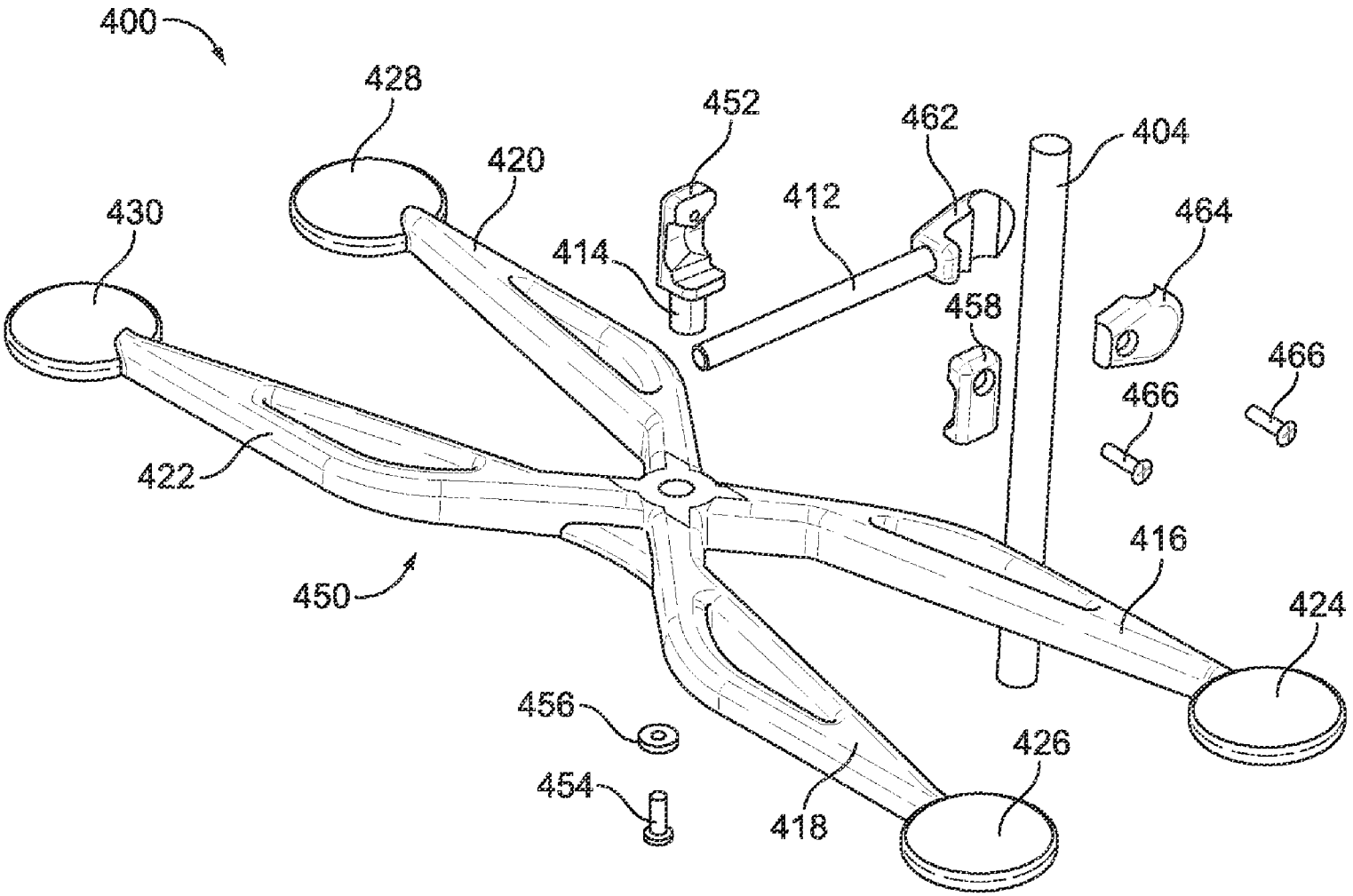
FIG. 5 is an exploded view of another embodiment of the invention.
Figure 6:
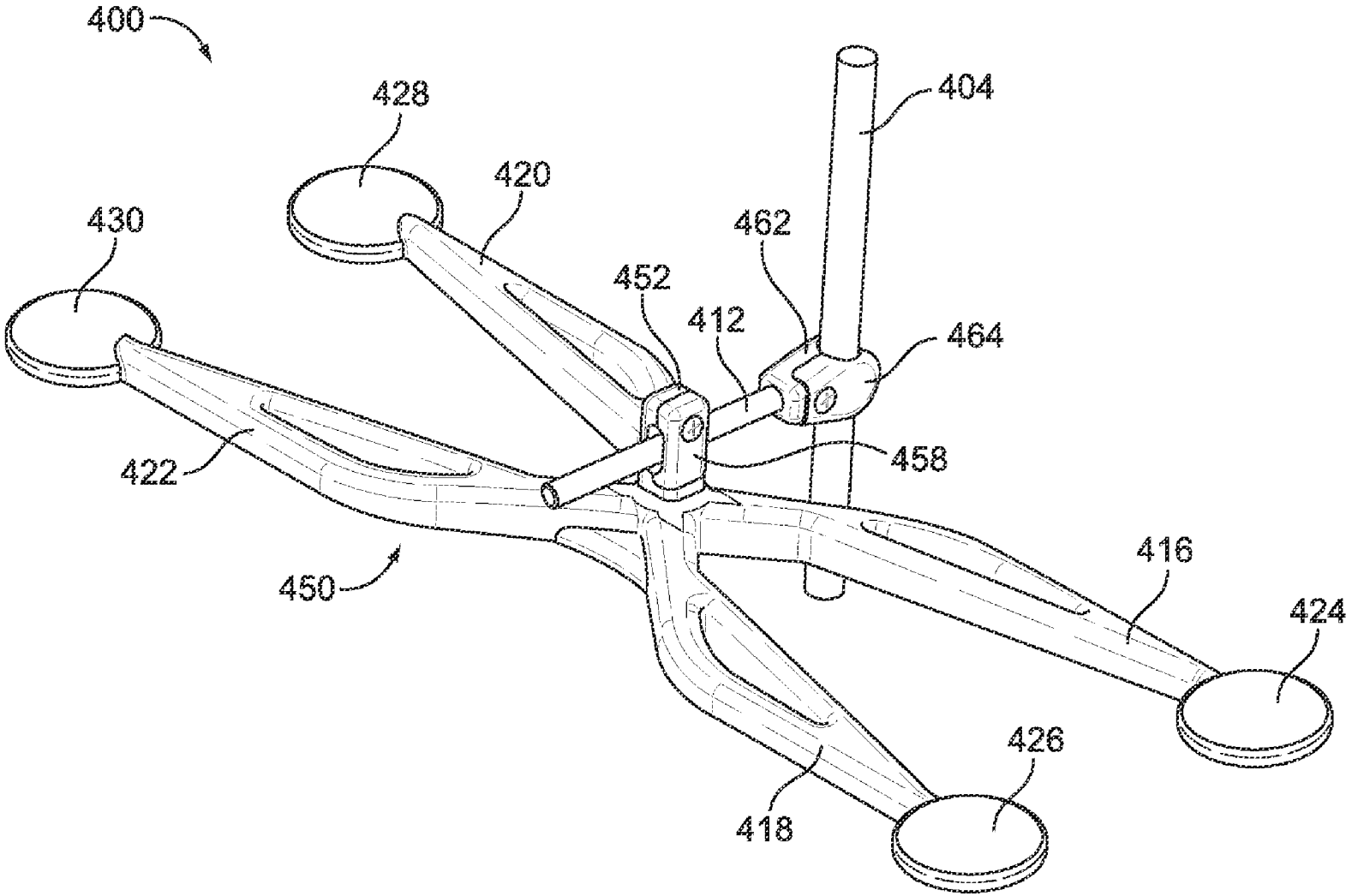
FIG. 6 is a perspective view of the embodiment of FIG. 5.

FIG. 2 shows a side view of the golf putter 102 and the golf putter training device 100. As shown, mounting bracket 112 may be any suitable device or component to attach the golf putter training device 100 to the golf putter shaft 104. In this example, mounting bracket 112 is a thin piece of metal that wraps around the shaft 104 of golf putter 102 and uses a bolt and nut 202 to firmly secure the mounting bracket 112 to the shaft 104 of the golf putter 102. It is understood, that any other suitable means, now known or later developed, may be used to attach the golf putter training device 100 to shaft 104 of the golf putter 102. For example, another embodiment of a mounting bracket is shown in FIG. 5, as will be described below.

Mounting bracket 112 is also attached to support shaft 114. In this example, a bolt 132 and a wing nut 134 is used to secure the support shaft 114 to the mounting bracket 112. It is understood, however, that support shaft 114 and mounting bracket 112 may be connected by any suitable means. It is further understood, for example, that support shaft 114 and mounting bracket 112 may be made from one piece. In this particular example, mounting bracket 112 is formed from a metal, and support shaft 114 is a dowel rod. It is understood, however, that any suitable material may be used for any of the components of the golf putter training device 100, such as, but not limited to, metal, wood, plastic, or any combination thereof. It is preferred, however, that the chosen material be light weight.

Figure 3:
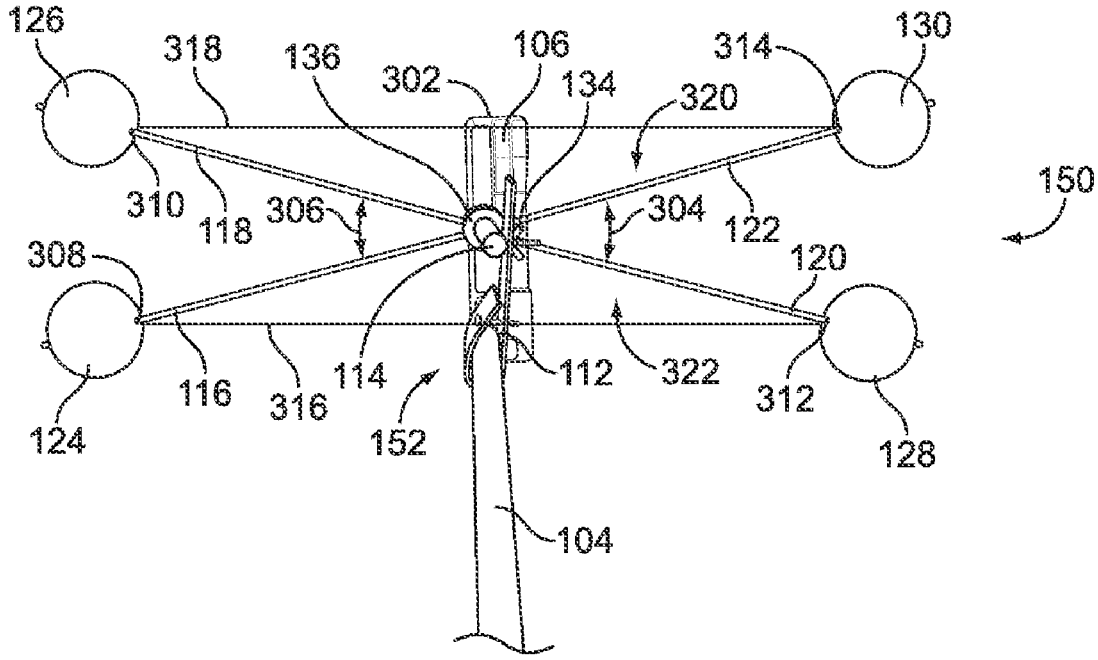
FIG. 3 is a top view of the golf putter training device shown in FIG. 1.

Turning now to FIG. 3, the support shaft 114 is positioned directly over the putting head 106. Additionally, support shaft 114 is positioned over the portion of the putting head 106 that a golfer would be desire to have make contact with a ball 110 during a putt. For example, support shaft 114 may be equidistant from the end 302 of the putting head 106 and where the shaft 104 is attached to the putting head 106. It is understood, however, that support shaft 114 may be positioned in any suitable location with respect to putting head 106, whether over putting head (from a top view) or not. Furthermore, in one example, support shaft 114 is perpendicular to the ground when the golfer is lining a golf putter 102 up for a putt. More specifically, when putting head 106 is substantially parallel to the ground 204 as shown in FIG. 2, the support shaft 114 is substantially perpendicular to both the putting head 106 and the ground 204. As one skilled in the art will recognize, however, various orientations and positions of mounting bracket 112 and support shaft 114 may be better suited for particular training exercises for enhancing one's golf putting skills.

Turning back to FIG. 3, visual guide assembly 150 comprising visual guides 116, 118, 120, and 122, is shown from a top view. Visual guide assembly 150 may also include a first outer visual guide 316 and a second outer visual guide 318, as described below. Visual guides 116 through 122 are connected to support shaft 114. In this example, a mounting ring 136 is adapted to receive support shaft 114. It is understood, however, that visual guides 116, 118, 120, and 122 may be directly mounted to support shaft 114. It is further understood, as described above, that the entire golf putter training device 100 may be made from one material and perhaps even one piece. For example, FIG. 5 shows a one-piece embodiment of visual guide assembly 450, as will later be described.

Visual guides 116, 118, 120, and 122 are preferably formed from a lightweight material, such as fiberglass or lightweight plastic or other similar material. When mounted to mounting ring 136, visual guides 116, 118, 120, and 122 are preferably substantially parallel to ground 204 when support shaft 114 is perpendicular thereto. Furthermore, angle 304 and angle 306 are preferably about 30°. However, it is understood that angles 304 and 306 may be any desired angle that may be used to help improve one's golf putting skills. Furthermore, angles 304 and 306 may not be equal. Additionally, it is understood that visual guides 116, 118, 120, and 122 need not be substantially parallel to ground 204. Visual guide assembly 150 may also include a first outer visual guide 316 and a second outer visual guide 318, as described below.

Visual guides 116, 118, 120, and 122 provide multiple forms of visual feedback to the golfer to help the golfer develop muscle memory of a good putting technique. For example, one problem that golfers have while putting is an unsteady swing. It is preferred that a golf putting swing be relatively smooth. Because of the extended length of visual aids 116, 118, 120, and 122, visual aids 116, 118, 120, and 122 have a tendency to show movement during an unsteady swing. Although unsteadiness may be seen by a careful observer watching putting head 106, the unsteadiness may be very difficult to see. Visual aids 116, 118, 120, and 122, however, amplify every movement that a putting head 106 makes during a swing. Not only will the golfer be able to have immediate feedback from the visual guides 116 through 122, an observer, such as a golf instructor, will better be able to perceive any undesired rotation or movement of a putting head 106 during a golf putter swing.

To further enhance the ability to observe and detect any undesired characteristics of a golf putter swing, golf putter training device 100 also includes one or more visual indicators. As shown in FIGS. 1 through 4, visual indicators 124, 126, 128, 130 are connected to an end 308, 310, 312, and 314 of visual guides 116 through 122, respectively. More specifically, visual indicator 124 is connected to end 308 of visual guide 116; visual indicator 126 is connected to end 310 of visual guide 118; visual indicator 128 is connected to end 312 of visual guide 120; and visual indicator 130 is connected to end 314 of visual guide 122. In one example, visual indicators 124 through 130 are table tennis balls, and each visual indicator 124 through 130 is connected to its respective visual guide 116 through 122 by inserting the ends of visual guides 116 through 122 through each of the table tennis balls. It is understood, however, that any suitable visual indicator 124 through 130 maybe used, such as a visual indicator made of plastic, cloth, metal, or any other suitable material or formed of another shape. For example, the alternative embodiment shown in FIG. 5, as will later be described, has visual indicators 424 through 430 formed in the shape of flat discs.

It is further contemplated, that visual indicators 124 through 130 maybe of any suitable color. In one example, visual indicators 124 through 130 are of a contrasting color that is easily visible compared to the color of the ground 204, which is usually green.

Another use of the visual guides 116 through 122 and visual indicators 124 through 130 is that a user may use the V shape that visual guides 116 and 118 form to help visualize whether the swing will allow the putting surface 108 to hit the ball 110 at the desired impact location. When aligned properly, the ball 110 should always visually appear directly between visual guides 116 and 118 during the swing. First outer visual guide 316 and second outer visual guide 318 create two parallel lines that help magnify the swing plane. This visual appearance is from the perspective of the golfer making the swing and having a substantially top view of the ball 110 and putting head 106. Furthermore, however, even a third person observer, such as a golf instructor, is able to observe the golfer's swing and determine whether the ball 110 was properly aligned (i.e., centered) during the swinging motion. The visual indicators 124 and 126 further help with the ability for one to watch the swing.

While the V-shape helps one visualize the golf putter 102 with respect to ball 110, golf putter training device 100 may further include one or more outer visual guides. As shown in FIG. 3, a first outer visual guide 316 is connected to visual indicators 124 and 128, and a second outer visual guide 318 is connected to visual indicators 126 and 130. It should be recognized, however, that outer visual guides 316, 318 may be directly connected to the visual guides 116, 118, 120, and 122. Outer visual guides 316 and 318 are substantially parallel to each other and are made of any suitable material, such as the same material used for visual guides 116-122, string, or any other suitable material, such as fiberglass, plastic, or any other suitable lightweight material. Outer visual guides 316 and 318 help a golfer visualize his or her swing with respect to the putter swing plane or swing line, i.e., the line that the golfer desires to follow to get the ball to a cup (assuming, of course, a perfect putting surface without any slopes or other characteristics that would not promote a direct putt into a hole).

To further elaborate on two of the visualizations that golf putter training device 100 enhances, other examples are now given. First, the "V" shape of visual guides 116 and 118 help the golfer to ensure that the putting surface 108 of the putting head 106 will make contact with ball 110 at the desired impact position, most likely the center of putting surface 108. A golfer does this by, while making a swing, ensuring that the ball 110 appears centered between visual guides 116 and 118. The outer, substantially parallel visual guides 316 and 318 help the golfer visualize the swing plane a distance from the ball, i.e., most likely the direction towards the hole.

For example, it is often difficult for a golfer to hit the ball 110 as desired. Even after properly lining a putting surface 108 up with a ball 110, a golfer may slightly twist the putting head 106 during swing 111 such that the putting surface 108 will not make contact with ball 110 at the desired angle. By amplifying the size of putting head 106 with visual guides 116 through 122 (and further enhanced with visual indicators 124 through 130 and outer visual guides 316 and 318), a golfer will more readily be able to visualize undesired movements during his or her swing. As such, the golfer may better be able to determine what portion of his or her swing has a problem, e.g., the swing away from the ball, back towards the ball, or both. Although use of golf putter training device 100 would most likely not be permitted during actual game play, especially during a sanctioned tournament, a golfer may build up muscle memory of a proper swing with sufficient practice and with proper focus on the visual feedback given by golf putter training device 100. Thus, when it comes time for the big game, the golfer will be able to rely on muscle memory to make the perfect putt.

Visual guides 116, 118, 120, and 122 are preferably mounted and positioned on support shaft 114 such that they are approximately six inches from the ground when the putting head 106 is resting and is parallel to ground 204. It is understood, however, that the distance between visual guides 116, 118, 120, and 122 may be adjusted or changed for any desired reason, such as based on personal preference or one's ability level. For example, a user may desire to place the visual guides 116 through 122 closer to the ground so that the visual guides 116 and 118 will actually make contact with ball 110 if the golfer is making an undesired swing that does not property align ball 110 with a desired impact area of putting surface 108.

Figure 4:
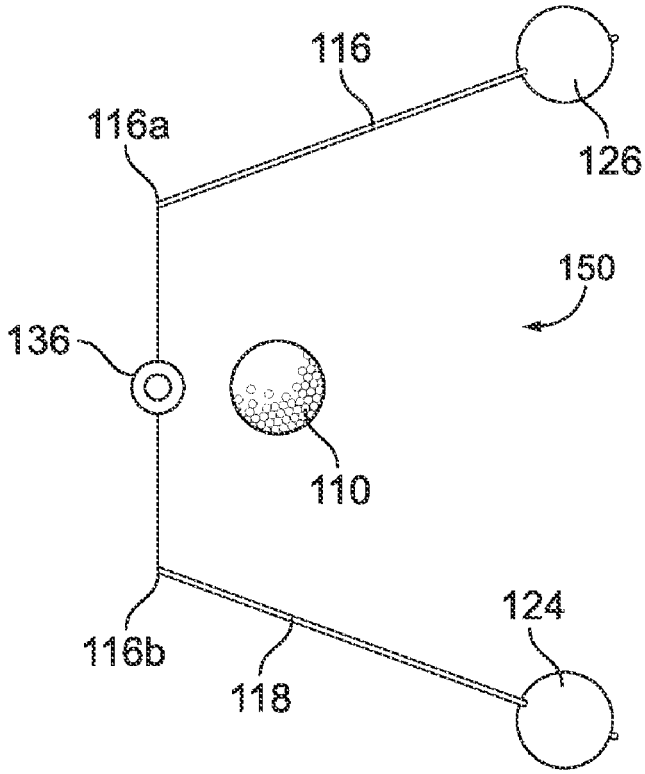
FIG. 4 is a top view of a portion of another example of visual guides on a golf putter training device.

As one skilled in the art will readily recognize, however, the "V" shape of the visual guides 116 and 118 would not permit ball 110 to even make contact with putting surface 108 if the visual guides 116-122 are lowered that close to the ground. It is contemplated, however, that the general "V" shape of the visual guides 116 and 118 may not form a pointed base of the "V." For example, as shown in FIG. 4, another example of the at least two visual guides 116 and 118 is shown. In this example, visual guides 116 and 118 are not straight but are instead bent at corner positions 116*a* and 116*b*, forming basically a "U" shape, thereby allowing ball 110 to fit between visual guides 116 and 118 if the visual guides 116 and 118 are lowered closer to the ground 204.

Another embodiment of the invention is shown in FIG. 5, for use on a putter having shaft 404. In this embodiment, golf putter training device 400 comprises a mounting bracket 412, a support shaft 414, and a visual guide assembly 450. Visual guide assembly 450 in this embodiment is a one-piece combination of visual guides 416, 418, 420, and 422, preferably formed integrally of injection-molded plastic. Visual indicators 424, 426, 428, and 430 are flat discs, either formed integrally with visual guide assembly 450 or attached by glue, threads, interference fit, fasteners, or other suitable means.

In this embodiment, support shaft 414 has a post clamp 452 at a top end. A screw 454 and washer 456 or other fasteners hold visual guide assembly 450 onto support shaft 414. Visual guide assembly 450 could also connect to support shaft 414 by glue or other adhesive, threads, screws, or other suitable fastening means. A post-clamp cap 458 mates with post clamp 452 to attach support shaft 414 to a distal end of bracket 412. A shaft clamp 462 at the proximal end of bracket 412 and a shaft clamp cap 464 attach bracket 412 to shaft 404 of a putter. The two caps 458, 464 can attach to the clamps 452, 462, respectively, using screws 466 or other suitable fastening means.

Golf putter training device 400 otherwise operates in the same manner as golf putter training device 100 as described above, the discussion of which is incorporated herein.

The example embodiments disclosed within are only examples and are not shown and described as a means of limitation, as many other variations and enhancements are contemplated for a golf putter training device 100. For example, it is known to use weights to weight different portions of a putting head (and even driver heads for other golf clubs). It is contemplated that the golf putter training device disclosed herein may further include weights to influence a golfer's swing. For example, the sizes, shapes, or masses of elements 124, 126, 128, 130, 424, 426, 428, 430 can be manipulated to influence the center of gravity of visual guide assemblies 150, 450, to influence a golfer's swing.

As another example, cover panels may be inserted between portions of the guides. For example, as shown in FIG. 3, a user would see the ground 204 (and a portion of putting head 106) in the triangular regions formed by angles 304 and 306. It is contemplated, however, that a panel may be placed over one or both of these regions. As yet another example, one skilled in the art will appreciate that different colors may be used for the various visual indicators and visual guides based on personal preference, ease of receiving different types of visual feedback, or any other suitable reason.

It is understood that the preceding is merely a detailed description of some examples and embodiments of the present design and that numerous changes to the disclosed embodiments can be made in accordance with the disclosure made herein without departing from the spirit or scope of the disclosure. The preceding description, therefore, is not meant to limit the scope of the disclosure but to provide sufficient disclosure to one of ordinary skill in the art to practice the disclosure without undue burden.

I claim:

1. A golf putter training device for use with a putter having a putter shaft connected to a putter head, the training device comprising:

a visual guide assembly comprising a first pair of visual guides forming a V;

a support configured to attach the visual guide assembly to the putter shaft and to position the visual guide assembly above the putter head; and a visual indicator connected to at least one of said visual guides at a distal end of said visual guide;

wherein said visual guide assembly further comprises a second pair of visual guides forming a V, said V formed by said second pair of visual guides pointing in a direction opposite the V formed by said first pair of visual guides, and said visual indicator has a color contrasting to green.

2. The device of claim 1, further comprising a first outer visual guide having a first end connected to a distal end of a first one of said first pair of visual guides and a second end connected to a distal end of a first one of said second pair of visual guides.

3. The device of claim 2, further comprising a second outer visual guide having a first end connected to a distal end of a second one of said first pair of visual guides and a second end connected to a distal end of a second one of said second pair of visual guides.

4. The device of claim 1, wherein said visual indicator comprises a round ball.

5. The device of claim 1, wherein said visual indicator comprises a disc.

6. A golf putter training device for use with a putter having a putter shaft connected to a putter head, the training device comprising:

a visual guide assembly comprising a first pair of visual guides forming a V;

a support configured to attach the visual guide assembly to the putter shaft and to position the visual guide assembly above the putter head; and a visual indicator connected to at least one of said visual guides at a distal end of said visual guide;

wherein said visual guide assembly further comprises a second pair of visual guides forming a V, said V formed by said second pair of visual guides pointing in a direction opposite the V formed by said first pair of visual guides, and said visual indicator comprises a round ball.

7. A golf putter training device for use with a putter having a putter shaft connected to a putter head, the training device comprising:

a visual guide assembly comprising a first pair of visual guides forming a V;

a support configured to attach the visual guide assembly to the putter shaft and to position the visual guide assembly above the putter head; and a visual indicator connected to at least one of said visual guides at a distal end of said visual guide;

wherein said visual guide assembly further comprises a second pair of visual guides forming a V, said V formed by said second pair of visual guides pointing in a direction opposite the V formed by said first pair of visual guides, and wherein said visual indicator comprises a disc.

* * * * *